US009104147B2

(12) United States Patent
Nagai

(10) Patent No.: US 9,104,147 B2
(45) Date of Patent: Aug. 11, 2015

(54) IMAGE FORMING APPARATUS WITH CONTROLLED FIXING TEMPERATURE, CONTROL METHOD AND STORAGE MEDIUM

(71) Applicant: CANON KABUSHIKI KAISHA, Tokyo (JP)

(72) Inventor: Jun Nagai, Tokyo (JP)

(73) Assignee: CANON KABUSHIKI KAISHA (JP)

( * ) Notice: Subject to any disclaimer, the term of this patent is extended or adjusted under 35 U.S.C. 154(b) by 10 days.

(21) Appl. No.: 14/048,064

(22) Filed: Oct. 8, 2013

(65) Prior Publication Data

US 2014/0126924 A1 May 8, 2014

(30) Foreign Application Priority Data

Nov. 2, 2012 (JP) ..... 2012-243154

(51) Int. Cl.
*G03G 15/20* (2006.01)
*G03G 15/00* (2006.01)

(52) U.S. Cl.
CPC ..... *G03G 15/205* (2013.01); *G03G 15/5004* (2013.01); *G03G 2215/2045* (2013.01)

(58) Field of Classification Search
CPC ..... G03G 15/2039; G03G 15/205; G03G 15/2078; G03G 15/5004; G03G 2215/2045; G03G 2215/2074
USPC ..... 399/37, 69, 88, 321, 328, 335; 219/216
See application file for complete search history.

(56) References Cited

U.S. PATENT DOCUMENTS

| | | | | |
|---|---|---|---|---|
| 8,886,107 | B2 * | 11/2014 | Tamura | 399/335 |
| 2003/0202812 | A1 * | 10/2003 | Kawamura | 399/67 |
| 2008/0089709 | A1 * | 4/2008 | Higashi | 399/79 |
| 2011/0078422 | A1 * | 3/2011 | Suzuki | 712/229 |
| 2012/0114358 | A1 * | 5/2012 | Sugiyama et al. | 399/69 |
| 2013/0084087 | A1 * | 4/2013 | Ikeda | 399/38 |
| 2013/0084093 | A1 * | 4/2013 | Namikata | 399/69 |
| 2014/0133878 | A1 * | 5/2014 | Okuzono | 399/69 |

FOREIGN PATENT DOCUMENTS

| | | | | |
|---|---|---|---|---|
| JP | 07314783 | A | * | 12/1995 |
| JP | 09090809 | A | * | 4/1997 |
| JP | 11-125987 | A | | 5/1999 |
| JP | 2004286806 | A | * | 10/2004 |
| JP | 2005266016 | A | * | 9/2005 |
| JP | 2006-162864 | A | | 6/2006 |
| JP | 2009151102 | A | * | 7/2009 |

* cited by examiner

*Primary Examiner* — Robert Beatty
(74) *Attorney, Agent, or Firm* — Rossi, Kimms & McDowell LLP

(57) ABSTRACT

An image forming apparatus according to an aspect of this invention controls a fixing temperature when a fixing device of a printer engine fixes an image on a recording material. More specifically, the image forming apparatus sets the fixing temperature to a value lower than that in a normal mode when printing an image in a power saving mode, and decides an amount of applied toner with which the fixing device can fix the image on the recording material at the set fixing temperature. Furthermore, the image forming apparatus generates print data corresponding to the decided amount of applied toner from input image data, and prints the image on the recording material based on the generated print data.

9 Claims, 7 Drawing Sheets

| OPERATION MODE | FIXING TEMPERATURE | AMOUNT OF APPLIED TONER |
|---|---|---|
| NORMAL MODE | 150°C | 200% |
| ENERGY SAVING MODE | 130°C | 100% |

| OPERATION MODE | | FIXING TEMPERATURE | FIXING SPEED | AMOUNT OF APPLIED TONER |
|---|---|---|---|---|
| NORMAL MODE | | 150°C | 20ppm | 200% |
| ENERGY SAVING MODE | SPEED PRIORITY | 130°C | 20ppm | 100% |
| | IMAGE QUALITY PRIORITY | 130°C | 15ppm | 200% |

IMAGE FORMING APPARATUS WITH CONTROLLED FIXING TEMPERATURE, CONTROL METHOD AND STORAGE MEDIUM

BACKGROUND OF THE INVENTION

1. Field of the Invention

The present invention relates to an image forming apparatus, a control method therefor, and a storage medium.

2. Description of the Related Art

In recent years, in terms of improvement of environmental awareness and reduction of an electricity rate, it has been desired to reduce power consumption for general electric appliances. Therefore, image forming apparatuses having a power saving mode (energy saving mode) in which power consumption is lower than that in a normal operation mode are increasing.

It is well known that in an image forming apparatus adopting an electrophotographic method which forms a toner image on a recording material and thermally fixes the formed toner image on the recording material by a fixing device, the power consumption of the fixing device accounts for most of the power consumption of the image forming apparatus. The following technique has thus been proposed. That is, when the image forming apparatus in the energy saving mode has not been used for a given time or longer, the temperature of the fixing device is lowered to reduce power supply to a heating unit (heater) included in the fixing device, thereby reducing the power consumption of the image forming apparatus. For example, Japanese Patent Laid-Open No. 2006-162864 proposes a technique of prompting a user to input power consumption or an electricity rate when an image forming apparatus is in a standby state, and controlling the temperature of a fixing device in the standby state based on the input value.

For the image forming apparatus adopting an electrophotographic method, the temperature of the fixing device is generally set in advance, and a largest amount of a color material (toner) applicable on a recording material is determined based on the set fixing temperature. Since especially a multi-color image forming apparatus performs image formation by superposing toners of a plurality of colors such as C (cyan), M (magenta), Y (yellow), and K (black), the amount of toner applied on the recording material tends to be large. In such multi-color image forming apparatus, a fixing temperature is set to obtain sufficient fixation even if the largest amount of toner is applied on a recording material. Japanese Patent Laid-Open No. 11-125987 proposes control of a fixing operation based on toner consumption amount information, which is applicable to a multi-color image forming apparatus. The image forming apparatus described in Japanese Patent Laid-Open No. 11-125987 lowers the fixing temperature of a fixing device in the power saving mode, and starts a printing operation when it is determined based on a toner consumption amount corresponding to an input image that a fixing operation is possible even if the fixing temperature has not reached a predetermined temperature. With this processing, an attempt is made to reduce the power consumption and shorten a time to return from the energy saving mode. (The amount of toner applied on a recording material will be referred to as an "amount of applied toner" hereinafter).

The above-described conventional technique, however, pays attention to only power consumption in the standby state, and performs no control of power consumption while an image forming (printing) operation is actually executed. When the image forming apparatus executes print processing at a high frequency, it almost never shifts to the standby state (energy saving mode), and thus the above-described conventional technique may not sufficiently reduce the power consumption.

Furthermore, in recent years, to level out power demands, power suppliers have introduced time-zone pricing which sets different electricity unit prices for different time zones. It is, therefore, desirable to attempt to reduce power consumption and electricity rate in an image forming apparatus by controlling the power consumption according to a change in electricity unit price. The above-described conventional technique, however, cannot perform such control.

SUMMARY OF THE INVENTION

The present invention has been made in consideration of the aforementioned problems, and provides a technique of reducing the power consumption of an image forming apparatus while preventing degradation in print quality as much as possible by appropriately controlling an amount of applied toner according to control of the fixing temperature of the image forming apparatus.

According to one aspect of the present invention, there is provided an image forming apparatus comprising: an image forming unit configured to form an image on a recording material based on input image data; a fixing control unit configured to control, based on a predetermined criterion, a fixing temperature corresponding to a temperature of a fixing unit included in the image forming unit when the fixing unit fixes the image on the recording material; a decision unit configured to decide an amount of applied toner which is on the recording material when the image forming unit performs image formation and with which the fixing unit is capable of fixing the image on the recording material at the fixing temperature controlled by the fixing control unit; an image processing unit configured to generate image data corresponding to the amount of applied toner decided by the decision unit from the input image data; and a control unit configured to control the image forming unit to form the image on the recording material based on the image data generated by the image processing unit.

According to another aspect of the present invention, there is provided a control method for an image forming apparatus including an image forming unit configured to form an image on a recording material based on input image data, the control method comprising steps of: controlling, based on a predetermined criterion, a fixing temperature corresponding to a temperature of a fixing unit included in the image forming unit when the fixing unit fixes the image on the recording material; deciding an amount of applied toner which is on the recording material when the image forming unit performs image formation and with which the fixing unit is capable of fixing the image on the recording material at the fixing temperature controlled in the controlling step; generating image data corresponding to the amount of applied toner decided in the deciding step from the input image data; and controlling the image forming unit to form the image on the recording material based on the image data generated in the generating step.

According to still another aspect of the present invention, there is provided a computer-readable storage medium storing a computer program for causing a computer to execute steps of a control method for an image forming apparatus including an image forming unit configured to form an image on a recording material based on input image data, the control method comprising steps of: controlling, based on a predetermined criterion, a fixing temperature corresponding to a temperature of a fixing unit included in the image forming unit when the fixing unit fixes the image on the recording material; deciding an amount of applied toner which is on the recording material when the image forming unit performs image formation and with which the fixing unit is capable of fixing the image on the recording material at the fixing temperature controlled in the controlling step; generating image data corresponding to the amount of applied toner decided in the deciding step from the input image data; and controlling the image forming unit to form the image on the recording material based on the image data generated in the generating step.

According to the present invention, there can be provided a technique of reducing the power consumption of an image forming apparatus while preventing degradation in print quality as much as possible by appropriately controlling the amount of applied toner according to control of the fixing temperature of the image forming apparatus. It is also possible to reduce a power rate by controlling the fixing temperature based on power price information.

Further features of the present invention will become apparent from the following description of exemplary embodiments with reference to the attached drawings.

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

[First Embodiment]

The first embodiment of the present invention will be described with reference to FIGS. 1 to 5. The present invention is applicable to an image forming apparatus adopting an electrophotographic method, such as a copying machine, multi-function peripheral (MFP), laser printer, or facsimile apparatus, regardless of whether the apparatus is a monochrome or multi-color apparatus. Note that in the first to third embodiments to be described below, an MFP including the scan function, print function, copy function, and transmission function will be exemplified as an image forming apparatus to which the present invention is applied. An MFP which can form a multi-color image on a recording material using developers (toners) of a plurality of colors (four colors of C, M, Y, and K) will also be explained by way of example.

<Hardware Configuration of Image Forming Apparatus>

Figure 1:
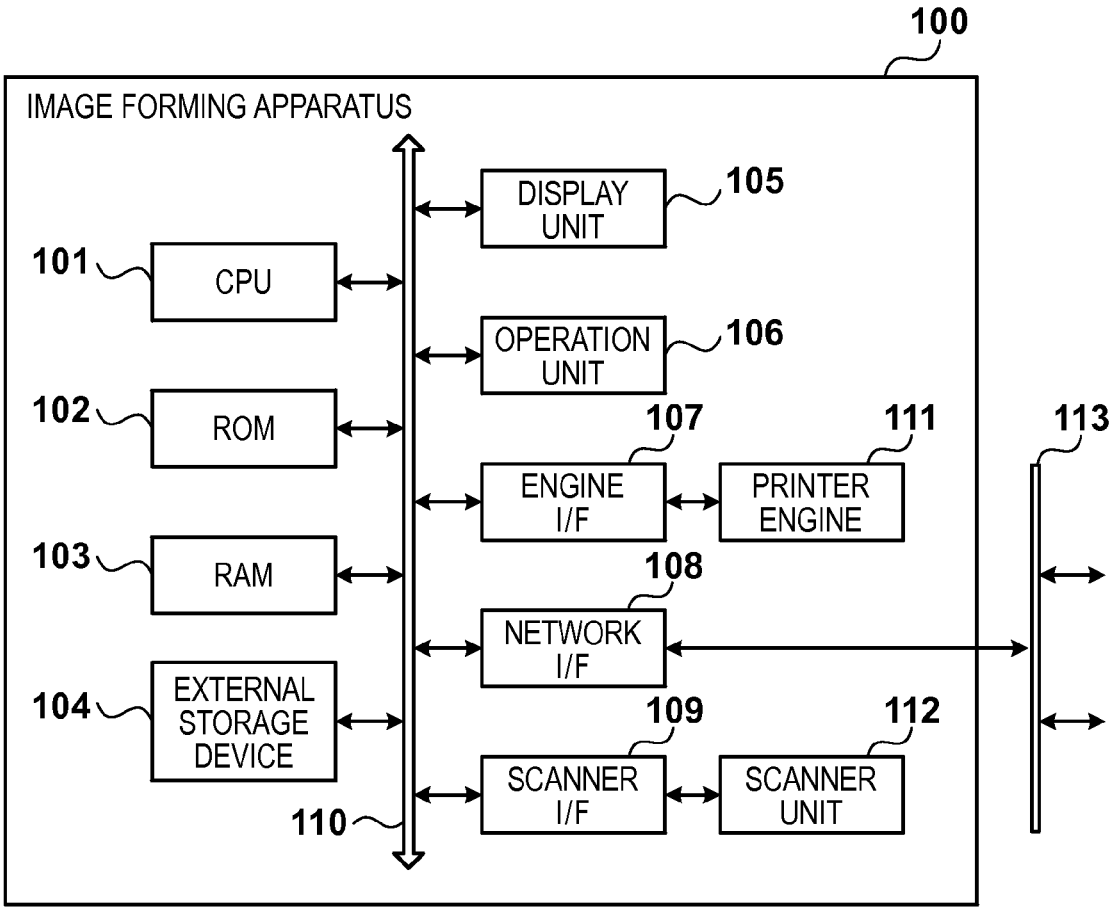
FIG. 1 is a block diagram showing the system configuration of an image forming apparatus 100 according to the first embodiment.

FIG. 1 is a block diagram showing the hardware configuration of an image forming apparatus 100 according to the first embodiment. The image forming apparatus 100 includes a CPU 101, ROM 102, RAM 103, external storage device 104, display unit 105, operation unit 106, engine I/F 107, network interface (I/F) 108, and scanner I/F 109, which are interconnected via a system bus 110. The image forming apparatus 100 also includes a printer engine 111 and scanner unit 112. The printer engine 111 and scanner unit 112 are connected to the system bus 110 via the engine I/F 107 and scanner I/F 109, respectively.

The CPU 101 controls the overall operation of the image forming apparatus 100. The CPU 101 executes various processes (to be described later) by reading out programs stored in the ROM 102 to the RAM 103, and executing them. The ROM 102 is a read only memory, which stores a system activation program, a program for controlling the printer engine, character data, character code information, and the like. The RAM 103 is a volatile random access memory, which is used as a work area by the CPU 101 and as a temporary storage area of various data. For example, the RAM 103 is used as a storage area for storing font data additionally registered by downloading, image files received from external apparatuses, and the like. The external storage device 104 includes, for example, a hard disk, which spools various data, stores programs, information files, image data, and the like, or is used as a work area.

The display unit 105 includes, for example, a liquid crystal display (LCD), which is used to display the setting status, the status of processing in progress, an error status, and the like of the image forming apparatus 100. The operation unit 106 includes an input device such as hard keys and a touch panel provided on the display unit 105, and accepts input (an instruction) by a user operation. The operation unit 106 is used to change or reset settings of the image forming apparatus 100, and to set the operation mode (printing mode) of the image forming apparatus 100 when executing image formation (printing). In this embodiment, the image forming apparatus 100 has, as the operation mode, a normal mode and a power saving mode (energy saving mode) in which the apparatus operates with power consumption lower than that in the normal mode. Note that the normal mode and energy saving mode are examples of a first operation mode and second operation mode, respectively.

The engine I/F 107 functions as an interface for controlling the printer engine 111 to execute printing in response to an instruction from the CPU 101. A command and the like are transmitted/received between the CPU 101 and printer engine 111 via the engine I/F 107. The network I/F 108 functions as an interface for connecting the image forming apparatus 100 to a network 113. Note that the network 113 may be, for example, a LAN or public switched telephone network (PSTN). Under the control of the CPU 101, the printer engine 111 forms (prints) an image on a recording material based on image data received from the system bus 110. The printer engine 111 includes a fixing device (fixing unit) for thermally fixing, on the recording material, a toner image transferred onto the recording material. The fixing device includes a heating unit (heater) for heating the recording material. The CPU 101 (a fixing temperature control unit 203 to be described later) controls the temperature (fixing temperature) of the heater at which the fixing device fixes the image on the recording material.

The scanner I/F 109 functions as an interface for controlling the scanner unit 112 to read a document in response to an instruction from the CPU 101. A command and the like are transmitted/received between the CPU 101 and scanner unit 112 via the scanner I/F 109. Under the control of the CPU 101, the scanner unit 112 reads an image of a document, generates image data, and transmits it to the RAM 103 or external storage device 104 via the scanner I/F 109.

<Functional Arrangement of Image Forming Apparatus>

Figures 2, 3:
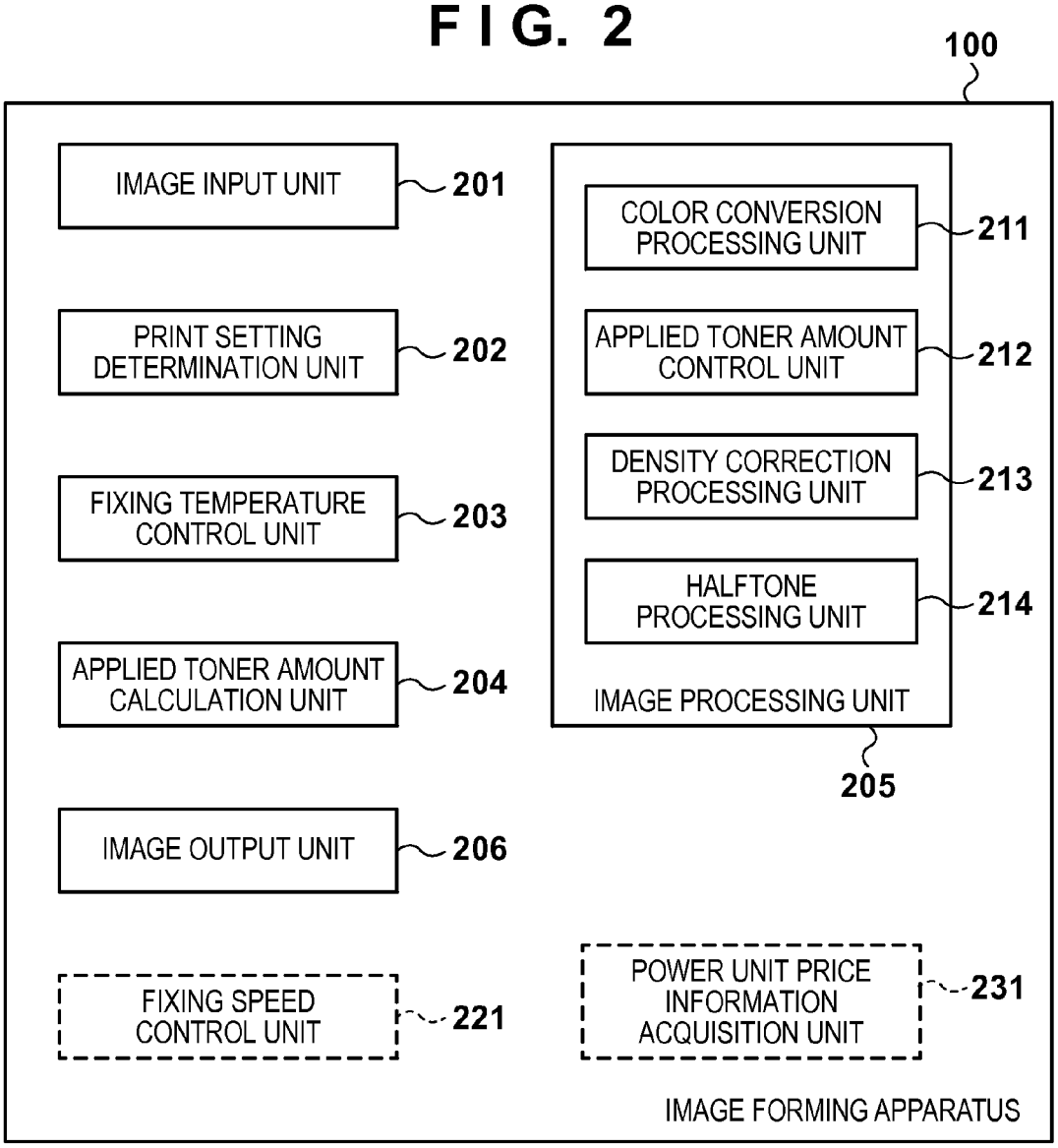
FIG. 2 is a block diagram showing the functional arrangement of the image forming apparatus 100 according to the first embodiment.
FIG. 3 is a table showing the relationships between the fixing temperature and the amount of applied toner in the image forming apparatus 100 according to the first embodiment.

FIG. 2 is a block diagram showing the functional arrangement of the image forming apparatus 100. The image forming apparatus 100 includes, as functional components, an image input unit 201, a print setting determination unit 202, the fixing temperature control unit 203, an applied toner amount calculation unit 204, an image processing unit 205, and an image output unit 206. These functional units are implemented on the image forming apparatus 100 when the CPU 101 reads out programs stored in the ROM 102 to the RAM 103, and executes them, respectively. Note that a fixing speed control unit 221 and power unit price information acquisition unit 231 shown in FIG. 2 are used in the second and third embodiments, respectively, and are not used in the first embodiment. Thus, the image forming apparatus 100 need not always include the units 221 and 231.

The image input unit 201 accepts input of image data to the image forming apparatus 100. The image data may be input via the network 113 and network I/F 108 from an external apparatus such as a PC, or the image data generated by the scanner unit 112 may be input via the scanner I/F 109. The input image data is, for example, a bitmap image. The image input unit 201 holds the image data accepted as an input in the RAM 103.

Based on a setting value specified by the user, the print setting determination unit 202 determines whether to operate the fixing device of the printer engine 111 at a predetermined temperature (normal set temperature) or a lower temperature (low set temperature). In this embodiment, this determination processing is performed by determining whether the image forming apparatus 100 has been set in the energy saving mode. In this embodiment, if the operation mode of the image forming apparatus 100 has been set to the energy saving mode, the print setting determination unit 202 determines to operate the fixing device at the low set temperature.

The fixing temperature control unit 203 controls the fixing temperature of the fixing device according to a predetermined criterion, as will be described later. In this embodiment (and the second embodiment), a case in which the fixing temperature control unit 203 controls the fixing temperature based on the operation mode of the image forming apparatus 100 when executing image formation based on the input image data will be described. Note that in the third embodiment (to be described later), a case in which the fixing temperature is controlled based on power unit price information acquired from an external apparatus will be explained. Note also that the fixing temperature control unit 203 is an example of a fixing control unit.

Based on the fixing temperature controlled (set) by the fixing temperature control unit 203, the applied toner amount calculation unit 204 decides (for example, calculates) an amount of applied toner with which the fixing device can fix an image on a recording material at the fixing temperature. The amount of fixable applied toner at a low fixing temperature is generally smaller than that at a normal fixing temperature. Note that the relationship between the fixing temperature and the amount of applied toner will be described later with reference to FIG. 3.

The image processing unit 205 executes image processing such as color conversion processing, density correction processing, and halftone processing for the input image data based on the amount of applied toner decided by the applied toner amount calculation unit 204. With this processing, the image processing unit 205 converts the input image data into image data (print data) corresponding to an image outputtable (printable on a recording material) by the image output unit 206. That is, the image processing unit 205 generates, from the input image data, print data corresponding to the amount of applied toner decided by the applied toner amount calculation unit 204. Note that as will be described later, the image processing unit 205 changes image processing to be applied to the input image data according to a print setting (for example, the operation mode such as the normal mode or energy saving mode).

The image output unit 206 transmits the print data generated by the image processing unit 205 to the printer engine 111 via the engine I/F 107 as a video signal. With this operation, the image output unit 206 controls the printer engine 111 to form an image on a recording material based on the print data generated by the image processing unit 205. The printer engine 111 prints the image on the recording material by executing exposure, development, transfer, and fixing processes.

<Relationship between Fixing Temperature and Amount of Applied Toner>

FIG. 3 is a table showing the relationships between the fixing temperature and the amount of applied toner in the normal mode and energy saving mode according to this embodiment. The print data generated by the image processing unit 205 is image data corresponding to toners of four colors (C, M, Y, and K). In this example, the sum of the signal values of C, M, Y, and K in a given pixel is defined as the total number of colors. Assume, for example, that the signal values of the respective colors are (C, M, Y, K)=(214, 200, 188, 20). In this case, the total number of colors is 214+200+188+20=622. In addition, the amount of applied toner is defined as the ratio of the total number of colors of the four colors (C, M, Y, and K) to the maximum number of colors (that is, a maximum signal value of 255) of a single color. If, for example, the total number of colors is 622 as described above, the amount of applied toner is 622/255≈2.44=240%.

In the example shown in FIG. 3, the fixing temperature in the normal mode is set to 150° C., and the fixing temperature in the energy saving mode is set to 130° C. which is lower than that in the normal mode. The amounts of applied toner at the fixing temperatures in the normal mode and energy saving mode are set to 200% and 100% in advance, respectively. This is because if the fixing temperature is set to the low temperature, the amount of fixable applied toner is smaller than that when the fixing temperature is set to the normal fixing temperature.

<Image Processing by Image Processing Unit>

As shown in FIG. 2, the image processing unit 205 includes a color conversion processing unit 211, an applied toner amount control unit 212, a density correction processing unit 213, and a halftone processing unit 214.

The color conversion processing unit 211 converts the input image data into data suitable for the image forming apparatus 100. If, for example, the input image data is RGB data and the image forming apparatus 100 is a multi-color printer using general C, M, Y, and K toners, the color conversion processing unit 211 applies processing of converting RGB data into CMYK data to the input image data. Note that if the input image data is CMYK data, the color conversion processing unit 211 need not execute processing for the image data.

Based on the image data obtained by the conversion processing executed by the color conversion processing unit 211, the applied toner amount control unit 212 generates image data corresponding to the amount of applied toner decided by the applied toner amount calculation unit 204. That is, the applied toner amount control unit 212 generates image data with an amount of applied toner equal to or smaller than that decided by the applied toner amount calculation unit 204.

Figure 4:
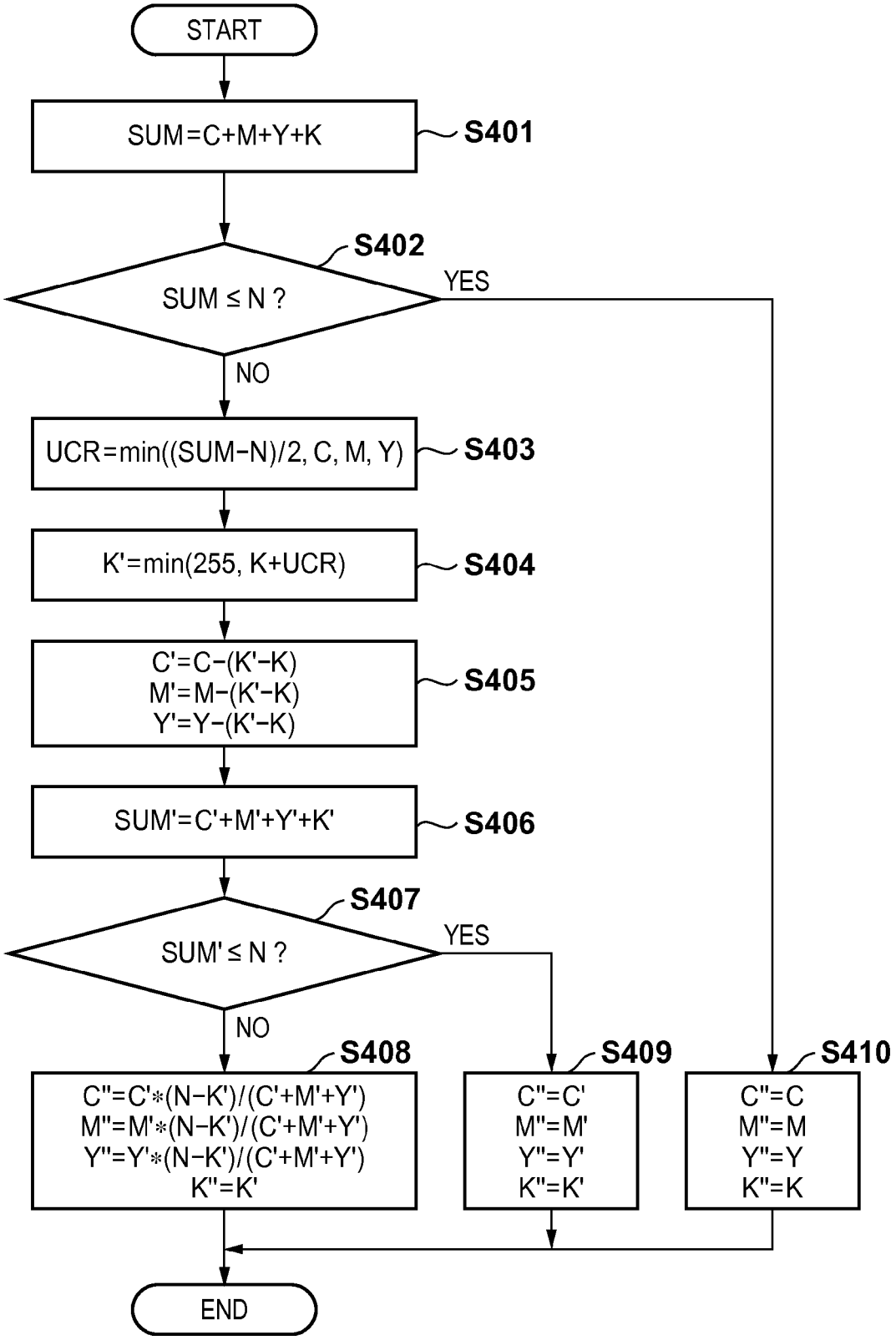
FIG. 4 is a flowchart illustrating a procedure of controlling the amount of applied toner, which is executed by a CPU 101 (applied toner amount control unit 212) of the image forming apparatus 100 according to the first embodiment.

FIG. 4 is a flowchart illustrating an example of a processing procedure executed by the applied toner amount control unit 212. Processing in each step of the flowchart shown in FIG. 4 is implemented on the image forming apparatus 100 when the CPU 101 reads out a program stored in the ROM 102 to the RAM 103 and executes it.

Upon start of control of the amount of applied toner, the applied toner amount control unit 212 obtains the sum of C, M, Y, and K signal values in a pixel of interest of the input image data in step S401. This obtained value is represented by SUM.

In step S402, the applied toner amount control unit 212 determines whether or not the value SUM is equal to or smaller than a limit value N of the sum (SUM≤N). Note that the limit value N is set based on the amount of applied toner decided by the applied toner amount calculation unit 204. In the example shown in FIG. 3, for example, the limit value N is set to 255×200%=510 in the normal mode, and is set to 255×100%=255 in the energy saving mode. If the applied toner amount control unit 212 determines in step S402 that the value SUM is equal to or smaller than the limit value N ("YES" in step S402), it advances the process to step S410; otherwise ("NO" in step S402), it advances the process to step S403.

Processing in steps S403 to S405 is general UCR (undercolor removal) processing. In step S403, the applied toner amount control unit 212 sets, as a value UCR, a smallest one of component values of the respective colors C, M, and Y, and half a value (SUM−N) which is an excess of the limit value N for the value SUM representing the sum of the signal values of the pixel of interest. Note that a division operation by 2 is implemented by 1-bit right shift processing.

In step S404, the applied toner amount control unit 212 sets, as a new K component value K' after the UCR processing, a smaller one of a possible maximum value (in this case, 255) of a K component value and a value obtained by adding the value UCR obtained in step S403 to an original K component value K.

Furthermore, in step S405, the applied toner amount control unit 212 sets, as C, M, and Y component values C', M', and Y' after the UCR processing, values obtained by subtracting the difference (that is, the component having undergone the undercolor removal processing) between the new K component value K' and the original K component value K from original C, M, and Y component values, respectively. In this way, the new color component values C', M', Y', and K' are obtained as the result of the UCR processing.

After that, in step S406, the applied toner amount control unit 212 obtains the sum of C', M', Y', and K', and sets it as a value SUM'. In step S407, the applied toner amount control unit 212 determines whether or not the value SUM' is equal to or smaller than the limit value N. If the applied toner amount control unit 212 determines that the value SUM' is equal to or smaller than the limit value N ("YES" in step S407), it advances the process to step S409; otherwise ("NO" in step S407), it advances the process to step S408.

In step S408, S409, or S410, the applied toner amount control unit 212 generates and outputs output color component values C", M", Y", and K" after controlling the amount of applied toner.

In step S408, the applied toner amount control unit 212 sets the K component value K' after the UCR processing intact as the output color component value K". Furthermore, the applied toner amount control unit 212 proportionally divides a value (N−K') obtained by subtracting the value K' (=K") from the limit value N at the ratio of the remaining input color component values C', M', and Y', and sets the thus obtained values as the output color component values C", M", and Y", respectively. In step S409, the applied toner amount control unit 212 sets the color component values C', M', Y', and K' after the UCR processing intact as the output color component values C", M", Y", and K", respectively. In step S410, the applied toner amount control unit 212 sets the input color component values C, M, Y, and K intact as the output color component values C", M", Y", and K".

Referring back to the description of the image processing unit 205 (FIG. 2), the density correction processing unit 213 performs correction processing of correcting the data obtained by the processing executed by the applied toner amount control unit 212 in accordance with a density characteristic unique to the printer engine 111. As a practical processing method, there are a method of using a density correction table for associating an input density level with an output density level, and a method of performing correction by calculation using a function.

The halftone processing unit 214 performs halftone processing for the data having undergone density correction by the density correction processing unit 213. In general, the printer engine 111 often supports only an output of a small number of tones such as 2, 4, and 16 tones. The halftone processing unit 214, therefore, executes halftone processing so as to output a halftone representation which is stable even if it is output with a small number of tones. Note that various methods such as a density pattern method, ordered dither method, and error diffusion method are applicable to the halftone processing executed by the halftone processing unit 214.

The above-described applied toner amount control operation is implemented by the UCR processing. However, the applied toner amount control operation is not always limited to the UCR processing, and can be implemented by, for example, decreasing the signal values of the respective colors C, M, Y, and K at an equal ratio.

Furthermore, the above-described applied toner amount control operation is applicable regardless of whether the input image data is RGB data or CMYK data. If, however, the input image data is RGB data, the following method is also applicable.

(Modification of Applied Toner Amount Control) In this example, the color conversion processing unit 211 executes color conversion processing by switching between a plurality of color conversion tables held in advance according to the set print setting (operation mode), and applying the color conversion table to the image data. That is, if the operation mode set as a print setting is the normal mode, the color conversion processing unit 211 applies a color conversion table for the normal mode. If the operation mode is the energy saving mode, the color conversion processing unit 211 applies a table for the energy saving mode.

A three-dimensional lookup table (LUT) is typically used for the color conversion processing based on a color conversion table. This table corresponds to a key table representing a correspondence for converting RGB data into CMYK data. The table is formed by N×N×N grid points. Therefore, it is possible to theoretically perform color conversion with high accuracy by making the grid spacing small enough. In fact, however, the obtainable number of grid points is limited in terms of a memory capacity, processing speed, and the like, and a point to undergo color conversion rarely coincides with a grid point. In general, therefore, a color value after the conversion processing is obtained by three-dimensional interpolation processing.

The color conversion processing in the energy saving mode is implemented by applying the color conversion table for the energy saving mode. The color conversion table for the energy saving mode is set so that the total number of colors of data at each grid point becomes a limit value based on the amount of applied toner decided by the applied toner amount calculation unit 204. When performing three-dimensional interpolation processing from grid points, if the total number of colors of data at a grid point is controlled not to exceed the limit value based on the amount of applied toner, a signal value obtained by the interpolation processing from the grid points does not exceed the limit value, either. It is thus possible to control the amount of applied toner in each mode by performing color conversion processing using a color conversion table corresponding to the operation mode (normal mode or energy saving mode).

Note that the density correction processing unit 213 executes density characteristic correction processing for the data processed by the color conversion processing unit 211, and the halftone processing unit 214 performs halftone processing for the data having undergone density correction by the density correction processing unit 213.

<Image Forming Processing>

Figures 5, 6:
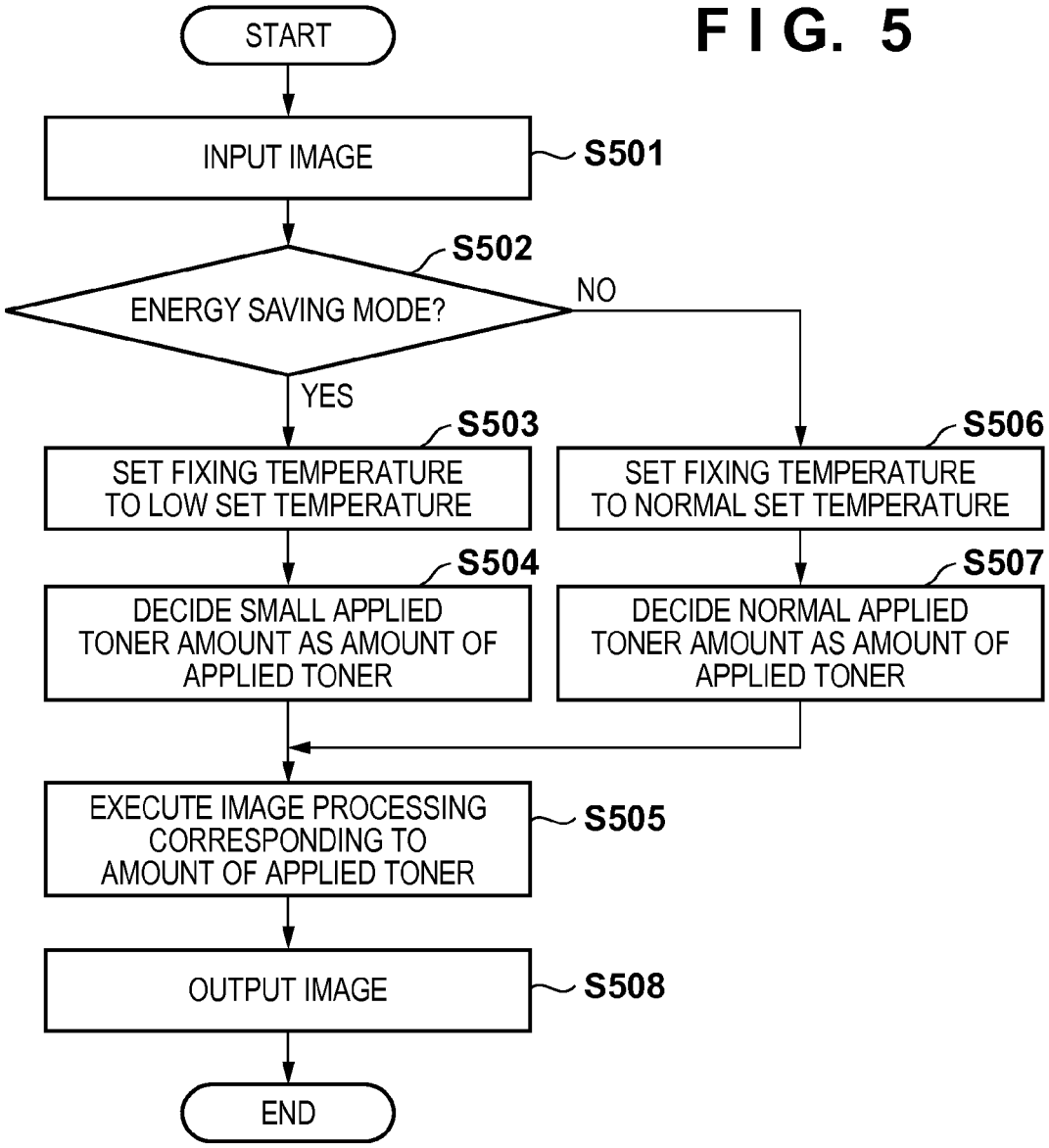
FIG. 5 is a flowchart illustrating an image forming processing procedure executed by the CPU 101 of the image forming apparatus 100 according to the first embodiment.
FIG. 6 is a table showing the relationships between the fixing temperature, fixing speed, and amount of applied toner in an image forming apparatus 100 according to the second embodiment.

FIG. 5 is a flowchart illustrating an image forming processing procedure executed by the CPU 101 of the image forming apparatus 100 according to this embodiment. Processing in each step of the flowchart shown in FIG. 5 is implemented on the image forming apparatus 100 when the CPU 101 reads out a program stored in the ROM 102 to the RAM 103 and executes it.

In step S501, the image input unit 201 accepts input of image data, and holds the input image data in the RAM 103.

In step S502, based on a setting value specified by the user, the print setting determination unit 202 determines whether to operate the fixing device at a predetermined temperature (normal set temperature) or a lower temperature (low set temperature). This determination processing is performed by determining whether or not the operation mode of the image forming apparatus 100 in executing printing has been set to, for example, the energy saving mode, as described above. The user can set the operation mode in executing printing using the operation unit 106.

If the print setting determination unit 202 determines in step S502 that a fixing operation is to be performed at the low set temperature ("YES" in step S502), it advances the process to step S503. In this case, in step S503, the fixing temperature control unit 203 sets the fixing temperature of the fixing device to the low set temperature, and advances the process to step S504. If, for example, the fixing temperature has been set to the normal set temperature, the fixing temperature control unit 203 changes the fixing temperature from the normal set temperature to the low set temperature. On the other hand, if the print setting determination unit 202 determines in step S502 that a fixing operation is to be performed at the normal set temperature ("NO" in step S502), it advances the process to step S506. In this case, in step S506, the fixing temperature control unit 203 sets the fixing temperature to the normal set temperature, and advances the process to step S507. If, for example, the fixing temperature has been set to the normal set temperature, the fixing temperature control unit 203 keeps the fixing temperature unchanged. As described above, if the image forming apparatus 100 has the two operation modes including the normal mode (first operation mode) and energy saving mode (second operation mode) as an operation mode in printing, the fixing temperature control unit 203 may lower the fixing temperature when executing printing in the energy saving mode as compared with that when executing printing in the normal mode.

In step S504 or S507, the applied toner amount calculation unit 204 decides (calculates) an amount of fixable applied toner at the corresponding fixing temperature. In step S504, the applied toner amount calculation unit 204 decides an amount of fixable applied toner (a small applied toner amount) corresponding to a case in which the fixing temperature has been controlled to the low set temperature. The amount of fixable applied toner in this case is smaller than that at the normal set temperature. On the other hand, in step S507, the applied toner amount calculation unit 204 calculates an amount of fixable applied toner (a normal applied toner amount) corresponding to a case in which the fixing temperature has been controlled to the normal set temperature.

The applied toner amount calculation unit 204 can decide an amount of applied toner based on, for example, the data with a list structure shown in FIG. 3. That is, the applied toner amount calculation unit 204 may decide, as an amount of applied toner on a recording material in image formation, a value which has been determined in advance based on the data with the list structure and corresponds to the fixing temperature controlled by the fixing temperature control unit 203 in step S503 or S506. Alternatively, the applied toner amount calculation unit 204 may calculate an amount of applied toner corresponding to the fixing temperature controlled by the fixing temperature control unit 203 by performing interpolation processing for values included in the one-dimensional LUT for defining the correspondence between the fixing temperature and the amount of applied toner.

In step S505, the image processing unit 205 executes image processing of generating print data corresponding to the decided amount of applied toner from the image data input in step S501 based on the amount of applied toner decided by the applied toner amount calculation unit 204. Furthermore, in step S508, the image output unit 206 transmits the print data generated by the image processing unit 205 to the printer engine 111 via the engine I/F 107, and controls the printer engine 111 to print an image on a recording material based on the print data.

As described above, based on a predetermined criterion, the image forming apparatus 100 according to the embodiment controls the fixing temperature at which the fixing device of the printer engine 111 fixes an image on a recording material. More specifically, the image forming apparatus 100 sets the fixing temperature to a value lower than that in the normal mode when printing an image in the power saving mode, and also decides an amount of applied toner with which the fixing device can fix the image on a recording material at the set fixing temperature. In addition, the image forming apparatus 100 generates print data corresponding to the decided amount of applied toner from the input image data, and prints the image on the recording material based on the generated print data. As described above, in this embodiment, while lowering the fixing temperature, printing is executed using the amount of fixable applied toner at the fixing temperature.

According to this embodiment, it is possible to efficiently reduce the power consumption of the image forming apparatus 100 while preventing degradation in print quality as much as possible by appropriately controlling the amount of applied toner according to control of the fixing temperature of the image forming apparatus 100.

Note that in this embodiment, control of the fixing temperature and the amount of applied toner has been described above by exemplifying a case in which the fixing temperature of the fixing device is controlled to one of two temperatures including the normal set temperature and low set temperature. The present invention, however, is not limited to this, and is applicable to case in which the fixing temperature is controlled to various values (for example, three or more discrete values or a continuously changing value). In this case, it is only necessary to decide a smaller amount of applied toner (within a range in which fixing on a recording material is possible) as the fixing temperature controlled based on a predetermined criterion is lower. As described above, even if the fixing temperature is controlled to various values, it is possible to obtain the same advantages as those in the above-described embodiment.

[Second Embodiment]

The image forming apparatus 100 according to the first embodiment reduces its power consumption while maintaining the print quality as high as possible by deciding the amount of fixable applied toner according to control of the fixing temperature of the fixing device (that is, control of power supply to the heater of the fixing device). If, for example, the apparatus sets the fixing temperature to the low set temperature in the energy saving mode, it correspondingly decides a small amount of applied toner within a range in which an image is fixable. If the apparatus decides a small amount of applied toner, a considerable influence is exerted on the print quality. This is because a reproducible color gamut becomes narrow as the amount of applied toner decreases.

On the other hand, it is well known that the amount of fixable applied toner at a given fixing temperature increases by lowering the image forming speed (print speed or fixing speed) of the printer engine 111. This is because a decrease in fixing speed increases a time during which it is possible to heat toner on a recording material, resulting in an increase in fixation of the toner on the recording material.

In the second embodiment, it is possible to suppress degradation in print quality as well as to suppress a decrease in amount of applied toner (or without decreasing the amount of applied toner) by further controlling a print speed according to a fixing temperature while controlling the fixing temperature of a fixing device in the same manner as that in the first embodiment. Note that for descriptive convenience, a description of a part common to the first embodiment will be omitted and the difference from the first embodiment will be mainly described below.

A case in which to lower the fixing temperature of the fixing device, an amount of applied toner or a print speed is controlled based on a setting indicating whether to prioritize the print quality (image quality) or print speed (fixing speed) will be exemplified below.

<Functional Arrangement of Image Forming Apparatus>

An image forming apparatus 100 according to the second embodiment includes a fixing speed control unit 221 shown in FIG. 2 in addition to the image forming apparatus 100 according to the first embodiment. That is, the image forming apparatus 100 includes an image input unit 201, a print setting determination unit 202, a fixing temperature control unit 203, an applied toner amount calculation unit 204, an image processing unit 205, an image output unit 206, and the fixing speed control unit 221.

Based on a setting value specified by the user, the print setting determination unit 202 determines whether to operate the fixing device of a printer engine 111 at a predetermined temperature (normal set temperature) or a lower temperature (low set temperature). In this embodiment, if an energy saving mode is set as an operation mode for printing and the fixing device is to be operated at the fixing temperature set to the low set temperature, the print setting determination unit 202 also determines whether it is set to prioritize the print speed (fixing speed) or print quality. This determination processing is also performed based on the setting value specified by the user.

The fixing speed control unit 221 controls the fixing speed of the printer engine 111 based on the set fixing temperature, as needed, as will be described later.

Based on the set fixing temperature and fixing speed, the applied toner amount calculation unit 204 decides (for example, calculates) an amount of applied toner with which the fixing device can fix an image on a recording material at the fixing temperature and the fixing speed. Details of the relationships between the fixing temperature, fixing speed, and amount of applied toner will be described later with reference to FIG. 6.

Note that the operations of the functional units except for the above-described ones are the same as those in the first embodiment.

<Relationships between Fixing Temperature, Fixing Speed, and Amount of Applied Toner>

FIG. 6 is a table showing the relationships between the fixing temperature, fixing speed, and amount of applied toner in the normal mode and energy saving mode according to this embodiment. In an example shown in FIG. 6, the fixing temperatures in the normal mode and energy saving mode are set to 150° C. and 130° C., respectively, similarly to the first embodiment (FIG. 3). The print speed (fixing speed) in the normal mode is set to 20 ppm.

In this embodiment, in the energy saving mode, if a speed priority setting is made, the fixing speed is set to 20 ppm equal to that in the normal mode while setting the amount of applied toner to 100% lower than that in the normal mode to ensure fixation. Alternatively, in the energy saving mode, if an image quality (print quality) priority setting is made, the amount of applied toner is set to 200% equal to that in the normal mode while reducing the fixing speed to 15 ppm to ensure fixation in order to obtain the same image quality as that in the normal mode.

<Image Forming Processing>

Figure 7:
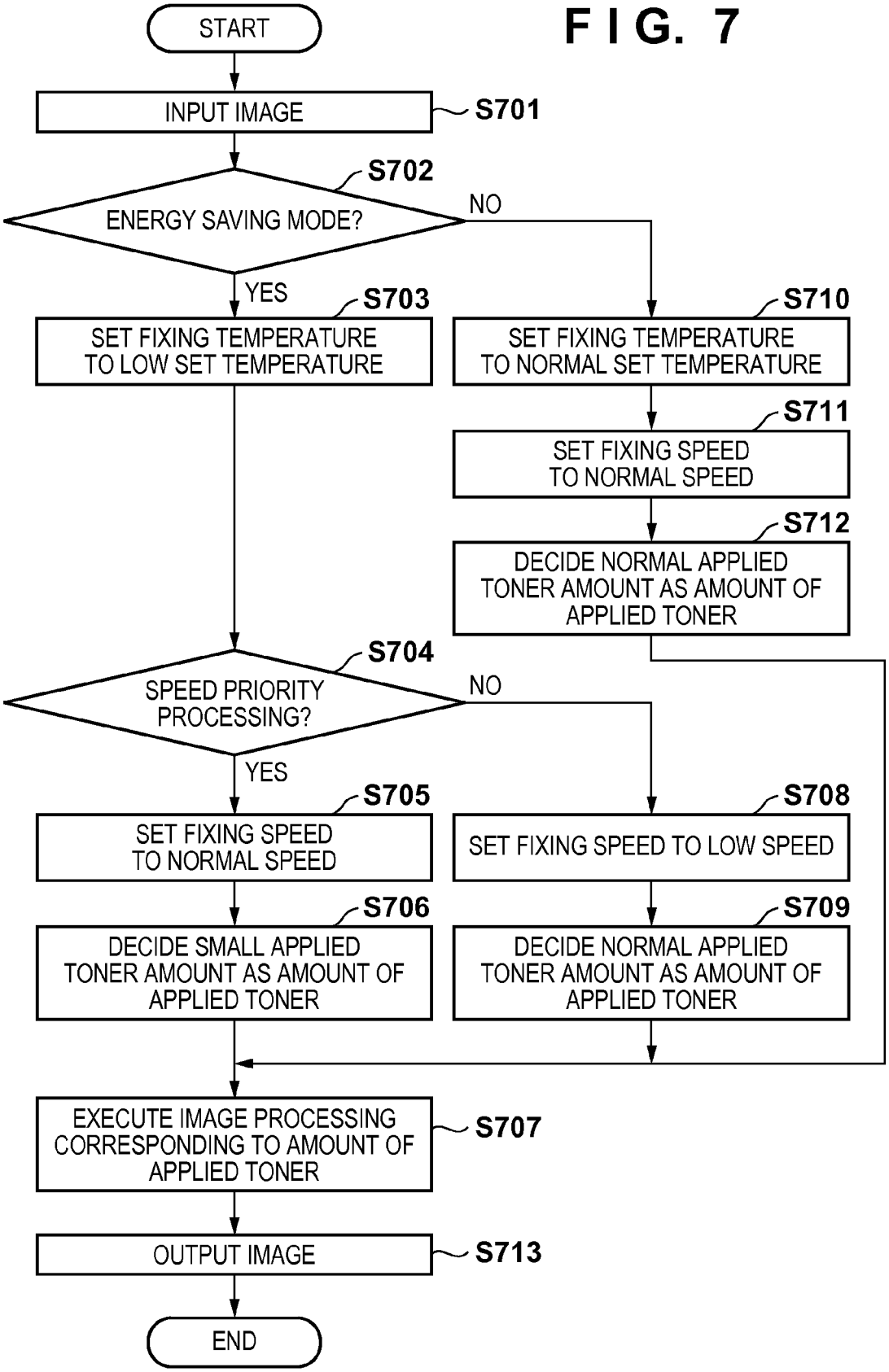
FIG. 7 is a flowchart illustrating an image forming processing procedure executed by a CPU 101 of the image forming apparatus 100 according to the second embodiment.

FIG. 7 is a flowchart illustrating an image forming processing procedure executed by a CPU 101 of the image forming apparatus 100 according to the embodiment. Processing in each step of the flowchart shown in FIG. 7 is implemented on the image forming apparatus 100 when the CPU 101 reads out a program stored in a ROM 102 to a RAM 103 and executes it.

Processes in steps S701 to S703 and S710 are the same as those in steps S501 to S503 and S506 in the first embodiment, respectively.

In step S703, the fixing temperature control unit 203 sets the fixing temperature of the fixing device to the low set temperature, and advances the process to step S704. In step S704, based on the setting value specified by the user, the print setting determination unit 202 determines whether to perform print speed priority print processing or image quality priority print processing. With this operation, the print setting determination unit 202 selects whether or not to lower the print speed when the fixing temperature is lowered. If the print setting determination unit 202 determines that print speed priority print processing is to be performed (that is, the print speed is not to be lowered) ("YES" in step S704), it advances the process to step S705. On the other hand, if the print setting determination unit 202 determines that image quality priority print processing is to be performed (that is, the print speed is to be lowered) ("NO" in step S605), it advances the process to step S708.

In step S705, the fixing speed control unit 221 sets the fixing speed to a normal speed (corresponding to the normal mode), and advances the process to step S706. On the other hand, in step S708, the fixing speed control unit 221 sets the fixing speed to a speed (low speed) lower than the normal speed, and advances the process to step S709. If, for example, the fixing speed has been set to the normal speed, the unit 221 changes the fixing speed from the normal speed to the low speed.

In step S710, the fixing temperature control unit 203 sets the fixing temperature of the fixing device to the normal set temperature, and then advances the process to step S711. In step S711, the fixing speed control unit 221 sets the fixing speed to the normal speed, and advances the process to step S712.

In step S706, S709, or S712, the applied toner amount calculation unit 204 decides (calculates) an amount of applied toner with which the fixing device can fix an image on a recording material at the corresponding fixing temperature and fixing speed. In step S706, the applied toner amount calculation unit 204 decides an amount of fixable applied toner (a small applied toner amount) corresponding to a case in which the fixing temperature is set to the low set temperature and the fixing speed is set to the normal speed. In step S709, the applied toner amount calculation unit 204 decides an amount of fixable applied toner (a normal applied toner amount) corresponding to a case in which the fixing temperature is set to the low set temperature and the fixing speed is set to the low speed. In this way, the applied toner amount calculation unit 204 decides an amount of applied toner so that the amount of applied toner (small applied toner amount) when it is selected to lower the fixing speed is larger than that (normal applied toner amount) when it is selected not to lower the fixing speed. In step S712, the applied toner amount calculation unit 204 decides an amount of fixable applied toner (a normal applied toner amount) corresponding to a case in which the fixing temperature is set to the normal set temperature and the fixing speed is set to the normal speed. Note that the applied toner amount calculation unit 204 can decide an amount of applied toner based on, for example, the data with a list structure shown in FIG. 6.

After step S706, S709, or S712, in step S707 the image processing unit 205 executes image processing of generating print data corresponding to the decided amount of applied toner from image data input in step S701 based on the amount of applied toner decided by the applied toner amount calculation unit 204. Furthermore, in step S713, the image output unit 206 transmits the print data generated by the image processing unit 205 to the printer engine 111 via an engine I/F 107, and controls the printer engine 111 to print an image on a recording material based on the print data.

As described above, according to this embodiment, it is possible to efficiently reduce the power consumption of the image forming apparatus 100 while preventing degradation in print quality as much as possible by appropriately controlling the amount of applied toner according to control of the fixing temperature of the image forming apparatus 100, similarly to the first embodiment. In addition, according to this embodiment, since a decrease in amount of applied toner can be suppressed (or the amount of applied toner is not decreased) by controlling the fixing speed even if the fixing temperature is lowered, it is possible to execute printing while suppressing degradation in print quality.

[Third Embodiment]

The image forming apparatus 100 according to the above-described first or second embodiment reduces its power consumption by controlling the fixing temperature of the fixing device, and also reduces degradation in print quality due to a decrease in amount of applied toner by deciding the amount of applied toner according to the fixing temperature.

In recent years, however, to level out power demands, power suppliers have introduced time-zone pricing which sets different electricity unit prices for different time zones. In this case, it is necessary to effectively reduce the power consumption according to a change in power price (that is, power supply) in addition to reducing the power consumption by the control operation described in the first or second embodiment.

To achieve this objective, in the third embodiment, a case in which power consumption is efficiently reduced by acquiring information indicating a power price from an external apparatus via a network, and controlling the fixing temperature of a fixing device based on the acquired information will be explained. Note that for descriptive convenience, a description of a part common to the first and second embodiments will be omitted and the difference from the first and second embodiments will be mainly described below.

<Functional Arrangement of Image Forming Apparatus>

An image forming apparatus 100 according to the third embodiment includes a power unit price information acquisition unit 231 shown in FIG. 2 in addition to the image forming apparatus 100 according to the first embodiment. That is, the image forming apparatus 100 includes an image input unit 201, a print setting determination unit 202, a fixing temperature control unit 203, an applied toner amount calculation unit 204, an image processing unit 205, an image output unit 206, and the power unit price information acquisition unit 231.

The power unit price information acquisition unit 231 periodically acquires power price information from an external apparatus via a network I/F 108. In this embodiment, the power price information is power unit price information indicating a power price per unit time (power unit price) which is changed (by a power company) depending on the time zone. Note that the power unit price is expressed in, for example, yen/kWh. The external apparatus serving as the acquisition source of the power unit price information is, for example, the management server (not shown) of the power company. The power unit price information acquisition unit 231 holds the acquired power unit price information in a RAM 103.

Based on a setting value specified by the user, the print setting determination unit 202 determines whether or not to control the fixing temperature of a fixing device based on the power unit price information.

Unlike the first embodiment in which the operation mode of the image forming apparatus 100 is used as a criterion, the fixing temperature control unit 203 controls the fixing temperature based on the power unit price information acquired by the power unit price information acquisition unit 231. That is, the fixing temperature control unit 203 decides (for example, calculates) a fixing temperature based on the power unit price information, and controls the fixing temperature of the fixing device to the decided temperature. Note that details of the relationships between a power unit price, a fixing temperature, and an amount of applied toner will be described later with reference to FIGS. 8A to 8C.

Note that the operations of the respective function units except for the above-describe ones are the same as those in the first embodiment.

<Relationship between Power Unit Price, Fixing Temperature, and Amount of Applied Toner>

Figure 8A:
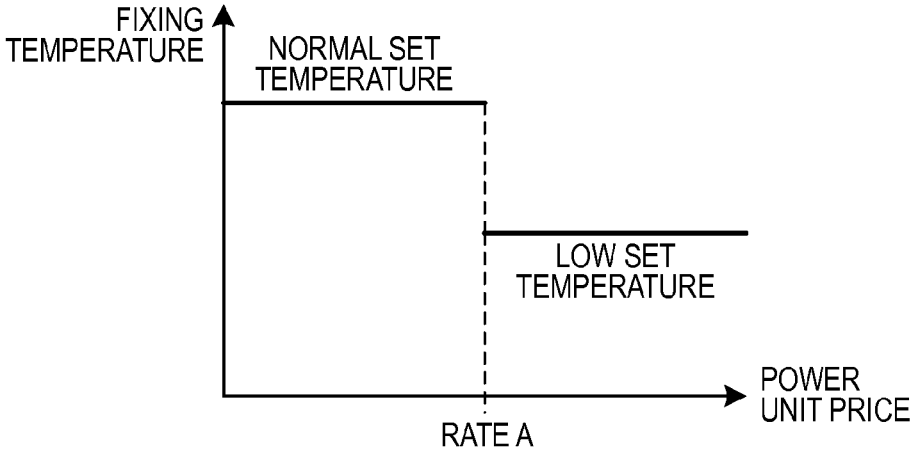
FIGS. 8A, 8B, and 8C are graphs showing the relationships between the power unit price, the fixing temperature, and the amount of applied toner in an image forming apparatus 100 according to the third embodiment.
Figure 8B:
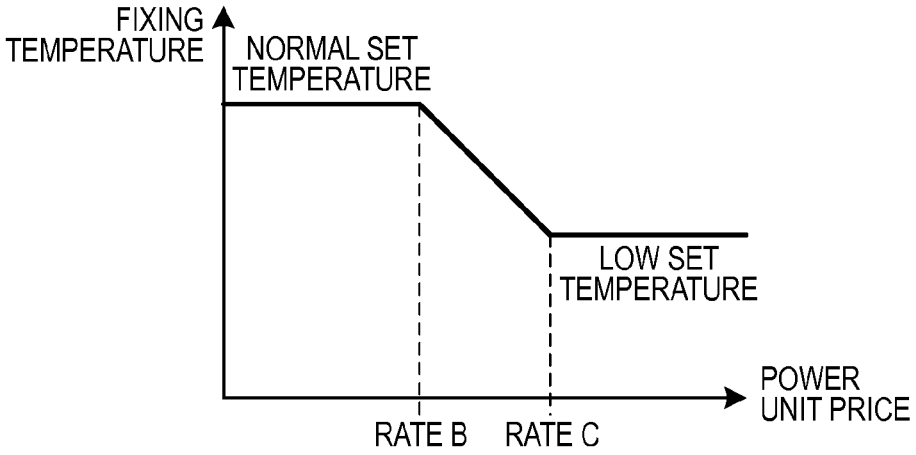
Figure 8C:
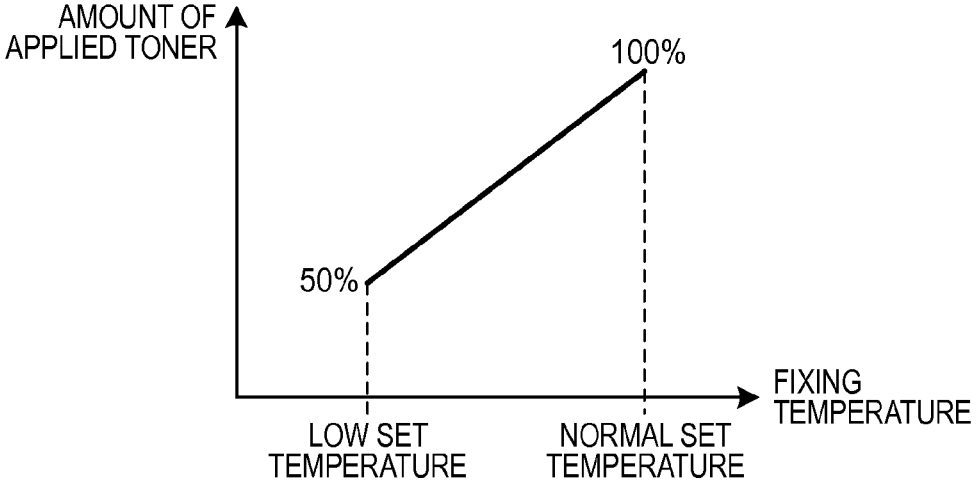

FIGS. 8A to 8C are graphs showing the relationships between the power unit price, the fixing temperature, and the amount of applied toner when controlling the fixing device based on the power unit price information according to this embodiment.

FIG. 8A shows a case in which the fixing temperature of the fixing device is controlled based on a comparison result between a power unit price and a predetermined threshold. In this case, if the power unit price is lower than the predetermined threshold (rate A), the fixing temperature is set to a normal set temperature (first temperature). If the power unit price is equal to or higher than the predetermined threshold (rate A), the fixing temperature is set to a low set temperature (second temperature). Note that the normal set temperature and low set temperature are the same as those described in the first embodiment. The predetermined threshold (rate A) may be arbitrarily set by the user.

FIG. 8B shows a case in which the fixing temperature of the fixing device is changed according to a power unit price. In this case, if the power unit price is lower than rate B, the fixing temperature is set to the normal set temperature. If the power unit price is higher than rate C, the fixing temperature is set to the low set temperature. Furthermore, if the power unit price falls within the range from rate B to rate C, the fixing temperature is changed in proportion to the power unit price. That is, as the power unit price increases, the fixing temperature is lowered. In this case, as shown in FIG. 8C, it is only necessary to decide the amount of applied toner according to the continuously changing fixing temperature, and decides a smaller amount of applied toner as the fixing temperature is lower. Note that prices B and C used as thresholds for determination with respect to the power unit price may be arbitrarily set by the user.

<Image Forming Processing>

Figure 9:
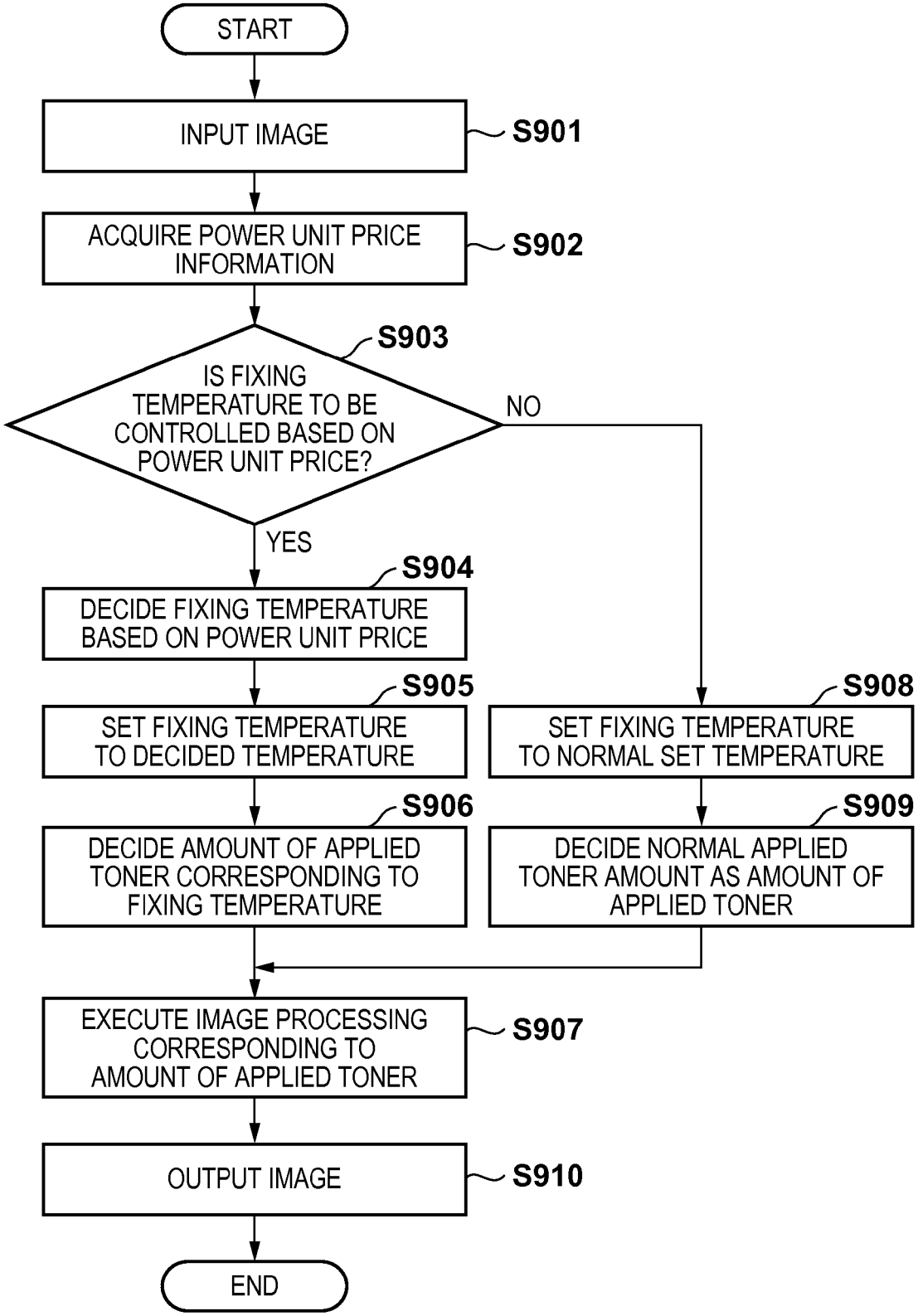
FIG. 9 is a flowchart illustrating an image forming processing procedure executed by a CPU 101 of the image forming apparatus 100 according to the third embodiment.

FIG. 9 is a flowchart illustrating image forming processing procedure executed by a CPU 101 of the image forming apparatus 100 according to this embodiment. Processing in each step of the flowchart shown in FIG. 9 is implemented on the image forming apparatus 100 when the CPU 101 reads out a program stored in a ROM 102 to a RAM 103 and executes it.

Processing in step S901 is the same as that in step S501 in the first embodiment. In step S902, the power unit price information acquisition unit 231 acquires power unit price information from an external apparatus via the network I/F 108, and holds the acquired power unit price information in the RAM 103.

In step S903, based on a setting value specified by the user, the print setting determination unit 202 determines whether or not to control the fixing temperature of the fixing device based on the power unit price information. The user can use an operation unit 106 to set whether or not to control the fixing temperature of the fixing device based on the power unit price information.

If the print setting determination unit 202 determines in step S903 that the fixing temperature of the fixing device is to be controlled based on the power unit price information ("YES" in step S903), it advances the process to step S904. In step S904, the fixing temperature control unit 203 decides a fixing temperature based on a power unit price indicated by the power unit price information. In step S905, the fixing temperature control unit 203 sets the fixing temperature of the fixing device to the temperature decided in step S904, and advances the process to step S906. The fixing temperature control unit 203 can calculate a fixing temperature corresponding to the power unit price by, for example, preparing a one-dimensional LUT for defining the relationships shown in FIGS. 8A to 8C, and performing interpolation processing for values included in the one-dimensional LUT.

On the other hand, if the print setting determination unit 202 determines in step S903 that the fixing temperature of the fixing device is not to be controlled based on the power unit price information ("NO" in step S903), it advances the process to step S908. In step S908, the fixing temperature control unit 203 sets the fixing temperature to the normal set temperature, and advances the process to step S909.

In step S906 or S909, the applied toner amount calculation unit 204 decides (calculates) an amount of fixable applied toner at the corresponding fixing temperature. This processing is the same as that in step S504 or S507 in the first embodiment.

After that, in step S907, the image processing unit 205 executes image processing of generating print data corresponding to the decided amount of applied toner from image data input in step S901 based on the amount of applied toner decided by the applied toner amount calculation unit 204. In step S910, the image output unit 206 transmits the print data generated by the image processing unit 205 to a printer engine 111 via an engine I/F 107, and controls the printer engine 111 to print an image on a recording material based on the print data.

As described above, the image forming apparatus 100 according to this embodiment acquires power unit price information from an external apparatus, and controls the fixing temperature of the fixing device based on the acquired unit price information. This can efficiently reduce the power consumption of the image forming apparatus 100 according to a power price. Especially, it is possible to reduce power consumption during a time zone when the power unit price is high, resulting in a lower power rate.

Note that the above-described first to third embodiments can be practiced by combining one or more embodiments, as needed.

[Other Embodiments]

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-243154, filed Nov. 2, 2012, which is hereby incorporated by reference herein in its entirety.

What is claimed is:

1. An image forming apparatus comprising:

an image forming unit configured to form an image on a recording material based on input image data;

an acquisition unit configured to acquire power price information from an external apparatus via a network;

a fixing control unit configured to control, based on the power price information acquired by the acquisition unit, a fixing temperature corresponding to a temperature of a fixing unit included in the image forming unit when the fixing unit fixes the image on the recording material;

a decision unit configured to decide an amount of applied toner which is on the recording material when the image forming unit performs image formation and with which the fixing unit is capable of fixing the image on the recording material at the fixing temperature controlled by the fixing control unit;

an image processing unit configured to generate image data corresponding to the amount of applied toner decided by the decision unit from the input image data; and a control unit configured to control the image forming unit to form the image on the recording material based on the image data generated by the image processing unit.

2. The apparatus according to claim 1, wherein the fixing control unit lowers the fixing temperature as a power price indicated by the power price information acquired by the acquisition unit is higher.

3. The apparatus according to claim 1, wherein if a power price indicated by the power price information acquired by the acquisition unit is lower than a predetermined threshold, the fixing control unit controls the fixing temperature to a first temperature, and if the power price is not lower than the predetermined threshold, the fixing control unit controls the fixing temperature to a second temperature lower than the first temperature.

4. The apparatus according to claim 1, wherein the power price information indicates a power price per unit time which is changed depending on a time zone, and the acquisition unit periodically acquires the power price information from the external apparatus.

5. The apparatus according to claim 1, wherein the decision unit decides a smaller value as the amount of applied toner as the fixing temperature controlled by the fixing control unit is lower.

6. The apparatus according to claim 1, further comprising a speed control unit configured to control an image forming speed of the image forming unit according to the fixing temperature controlled by the fixing control unit, wherein the decision unit decides an amount of applied toner with which the fixing unit is capable of fixing the image on the recording material at the fixing temperature controlled by the fixing control unit and at the image forming speed controlled by the speed control unit.

7. The apparatus according to claim 1, further comprising a selection unit configured to select, when the fixing control unit lowers the fixing temperature, whether to lower the image forming speed of the image forming unit, and a speed control unit configured to control the image forming speed according to the selection by the selection unit, wherein the decision unit decides the amount of applied toner so that the amount of applied toner when the selection unit selects to lower the image forming speed becomes larger than that when the selection unit selects not to lower the image forming speed.

8. A control method for an image forming apparatus including an image forming unit configured to form an image on a recording material based on input image data, the control method comprising steps of:

acquiring power price information from an external apparatus via a network;

controlling, based on the power price information acquired in the acquiring step, a fixing temperature corresponding to a temperature of a fixing unit included in the image forming unit when the fixing unit fixes the image on the recording material;

deciding an amount of applied toner which is on the recording material when the image forming unit performs image formation and with which the fixing unit is capable of fixing the image on the recording material at the fixing temperature controlled in the controlling step;

generating image data corresponding to the amount of applied toner decided in the deciding step from the input image data; and controlling the image forming unit to form the image on the recording material based on the image data generated in the generating step.

9. A computer-readable storage medium storing a computer program for causing a computer to execute steps of a control method for an image forming apparatus including an image forming unit configured to form an image on a recording material based on input image data, the control method comprising steps of:

acquiring power price information from an external apparatus via a network;

controlling, based on the power price information acquired in the acquiring step, a fixing temperature corresponding to a temperature of a fixing unit included in the image forming unit when the fixing unit fixes the image on the recording material;

deciding an amount of applied toner which is on the recording material when the image forming unit performs image formation and with which the fixing unit is capable of fixing the image on the recording material at the fixing temperature controlled in the controlling step;

generating image data corresponding to the amount of applied toner decided in the deciding step from the input image data; and controlling the image forming unit to form the image on the recording material based on the image data generated in the generating step.

* * * * *